US009803804B2

(12) United States Patent
Stenzler et al.

(10) Patent No.: US 9,803,804 B2
(45) Date of Patent: Oct. 31, 2017

(54) GAS CYLINDER INTERLOCK DEVICE AND METHOD OF USE

(71) Applicant: 12th Man Technologies, Inc., Garden Grove, CA (US)

(72) Inventors: Alex Stenzler, Long Beach, CA (US); Steve Han, Huntington Beach, CA (US)

(73) Assignee: 12TH MAN TECHNOLOGIES, INC., Garden Grove, CA (US)

( * ) Notice: Subject to any disclaimer, the term of this patent is extended or adjusted under 35 U.S.C. 154(b) by 61 days.

(21) Appl. No.: 14/560,324

(22) Filed: Dec. 4, 2014

(65) Prior Publication Data

US 2015/0153004 A1 Jun. 4, 2015

Related U.S. Application Data

(60) Provisional application No. 61/911,788, filed on Dec. 4, 2013.

(51) Int. Cl.

| | |
|---|---|
| ***B65B 1/04*** | (2006.01) |
| ***F17C 7/00*** | (2006.01) |
| ***B65D 55/10*** | (2006.01) |
| ***F17C 1/00*** | (2006.01) |

(52) U.S. Cl.

CPC ..... *F17C 7/00* (2013.01); *B65D 55/10* (2013.01); *F17C 1/00* (2013.01); *F17C 2201/0104* (2013.01); *F17C 2201/056* (2013.01); *F17C 2205/0308* (2013.01); *F17C 2205/0326* (2013.01); *F17C 2205/0394* (2013.01); *F17C 2221/011* (2013.01); *F17C 2221/013* (2013.01); *F17C 2221/014* (2013.01); *F17C 2221/035* (2013.01); *F17C 2223/0123* (2013.01); *F17C 2223/0153* (2013.01); *F17C 2223/033* (2013.01); *F17C 2223/035* (2013.01); *F17C 2223/043* (2013.01); *F17C 2250/032* (2013.01); *F17C 2250/043* (2013.01); *F17C 2250/0452* (2013.01); *F17C 2250/0491* (2013.01); *F17C 2250/077* (2013.01); *F17C 2260/028* (2013.01); *F17C 2260/044* (2013.01); *F17C 2270/025* (2013.01); *F17C 2270/0545* (2013.01); *F17C 2270/0736* (2013.01);

(Continued)

(58) Field of Classification Search

CPC . F17C 2205/03–2205/0308; F17C 2205/0388; F17C 2205/0394; F17C 2250/00; F17C 2250/03; F17C 2250/032; F17C 2250/034; F17C 2250/043; F17C 2250/0434; F17C 2250/0447; F17C 2250/0452; F17C 2250/0486; F17C 2250/091

See application file for complete search history.

(56) References Cited

U.S. PATENT DOCUMENTS 1,706,051 A * 3/1929 Auchincloss ..... F16J 13/24 220/288

3,383,123 A 5/1968 Murray (Continued)

*Primary Examiner* — Patrick M Buechner
*Assistant Examiner* — Randall Gruby
(74) *Attorney, Agent, or Firm* — Riverside Law LLP

(57) ABSTRACT

The present invention relates to devices, systems, and methods for a safety interlock for a gas cylinder. The interlock device of the present invention can prevent a gas cylinder from being removed from a gas administration device as long as gas remains in the gas cylinder.

7 Claims, 4 Drawing Sheets

(52) U.S. Cl.
CPC . *F17C 2270/0745* (2013.01); *Y10T 137/0441* (2015.04); *Y10T 137/1632* (2015.04)

(56) References Cited

U.S. PATENT DOCUMENTS 4,519,635 A * 5/1985 McMath ..... F16L 37/18 285/312
4,757,261 A * 7/1988 Kneip, Jr. ..... F17C 13/025 324/319
5,048,874 A * 9/1991 Ohlsson ..... F16L 37/0987 285/307
5,287,702 A * 2/1994 Blackshaw ..... A62C 35/02 169/11
5,687,777 A * 11/1997 Dobson ..... A61M 16/183 141/18
5,894,869 A * 4/1999 Mussack ..... B67D 1/0412 141/19
6,676,172 B2 * 1/2004 Alksnis ..... A61M 16/186 215/43
6,824,911 B2 * 11/2004 Franklin ..... H01M 8/04089 429/446
7,069,807 B2 * 7/2006 Girlando ..... F16H 63/38 74/473.18
8,191,740 B2 6/2012 Hoss et al.
8,327,892 B2 * 12/2012 Rindy ..... A61M 16/183 141/2
8,613,297 B2 * 12/2013 Adams ..... F16K 15/063 141/20
8,757,148 B2 * 6/2014 Montgomery ..... A61M 16/12 128/203.12
8,876,169 B2 * 11/2014 Chen ..... F16L 37/18 285/312
2002/0178783 A1 12/2002 Miller et al.
2004/0021316 A1 * 2/2004 Rogg ..... B60T 11/30 285/308
2008/0017821 A1 1/2008 Orban et al.
2008/0315581 A1 * 12/2008 White ..... B05B 15/065 285/308
2010/0213083 A1 * 8/2010 Olander ..... F17C 11/00 206/0.7
2012/0048396 A1 3/2012 Takemoto
2012/0318534 A1 12/2012 Dahlgren et al.
2013/0199021 A1 * 8/2013 Jupe ..... F16L 21/08 29/525.01
2015/0174360 A1 * 6/2015 Stenzler ..... A61M 16/127 128/203.12
2015/0225048 A1 * 8/2015 Lee ..... B63C 9/155 141/329
2015/0329341 A1 * 11/2015 Wilder ..... B67D 1/0071 206/0.6
2016/0348847 A1 * 12/2016 Wilder ..... F17C 13/06

* cited by examiner

GAS CYLINDER INTERLOCK DEVICE AND METHOD OF USE

CROSS-REFERENCE TO RELATED APPLICATIONS

This application claims priority to U.S. provisional application No. 61/911,788 filed on Dec. 4, 2013 incorporated herein by reference in its entirety.

BACKGROUND OF THE INVENTION

Gas-filled containers are used in many different types of applications. For example, gas cylinders or cartridges can be used in medical applications, e.g., for the administration of oxygen or therapeutic gases; in industrial applications, e.g., for inerting with gases such as nitrogen, or for welding; and even in consumer applications, e.g., providing fuel for cooking or for use with carbonating beverage machines.

However, gas-filled containers, especially small, portable containers without valves, can pose a number of safety risks. Gas cylinders or cartridges are typically pressurized and can become a dangerous projectile if not properly secured. Also, gas cylinders that contain poisonous gases or therapeutic gases can pose a risk to a person's health if the cylinders emit high concentrations of the gas to the surrounding atmosphere. Similarly, gas cylinders that contain a gas other than air or oxygen can pose an asphyxiation risk if they emit the gas in a closed environment.

In current applications, gas cylinders may not be safely secured while in use. For example, relatively small gas cylinders are often secured only by a threaded connection to a manifold or other device. Such a threaded connection does not prevent a person from detaching the gas cylinder from the manifold or other device prior to all of the gas in the cylinder being used. Accordingly, a person detaching a cylinder that is not empty can be exposed to gas in the cylinder, or can be at risk for injury if the cylinder becomes a projectile due to the thrust created from quickly expelling gas. In applications using a therapeutic gas, such as nitric oxide, exposure to larger amounts of the gas can create a health risk.

Thus, there is a need in the art for an interlock device that safely secures a gas cylinder to a manifold or other device, and that also prevents a user from removing the gas cylinder from the device while there is still gas remaining in the cylinder. The present invention addresses this continuing need in the art.

BRIEF DESCRIPTION OF THE DRAWINGS

The following detailed description of preferred embodiments of the invention will be better understood when read in conjunction with the appended drawings. For the purpose of illustrating the invention, there are shown in the drawings embodiments which are presently preferred. It should be understood, however, that the invention is not limited to the precise arrangements and instrumentalities of the embodiments shown in the drawings.

DETAILED DESCRIPTION

Figure 1:
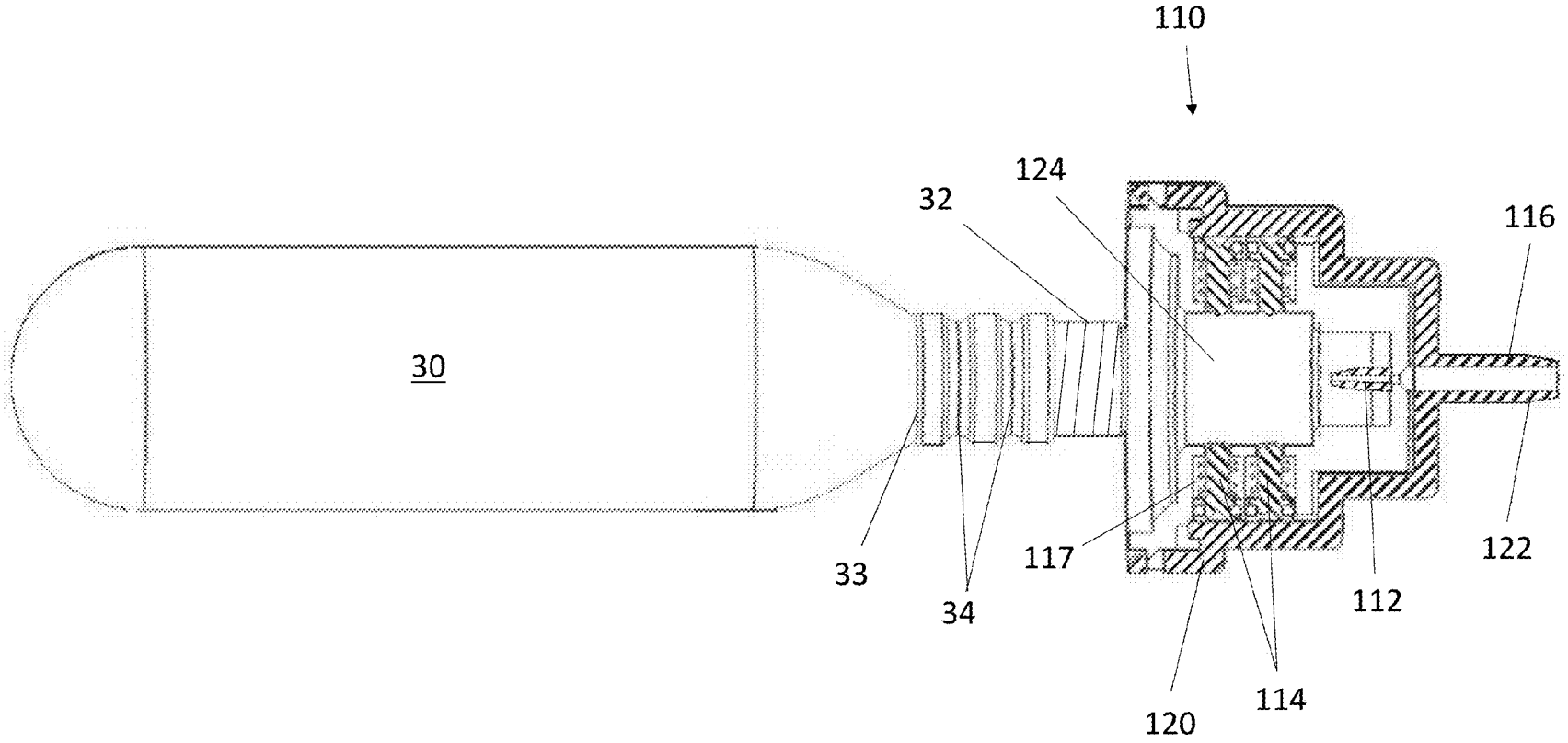
FIG. 1 is a schematic diagram of an exemplary embodiment of a gas cylinder interlock device of the present invention, detached from a gas cylinder.

It is to be understood that the figures and descriptions of the present invention have been simplified to illustrate elements that are relevant for a clear understanding of the present invention, while eliminating, for the purpose of clarity, many other elements found in typical interlocking systems and devices for gas containers. Those of ordinary skill in the art may recognize that other elements and/or steps are desirable and/or required in implementing the present invention. However, because such elements and steps are well known in the art, and because they do not facilitate a better understanding of the present invention, a discussion of such elements and steps is not provided herein. The disclosure herein is directed to all such variations and modifications to such elements and methods known to those skilled in the art.

Unless defined otherwise, all technical and scientific terms used herein have the same meaning as commonly understood by one of ordinary skill in the art to which this invention belongs. Although any methods and materials similar or equivalent to those described herein can be used in the practice or testing of the present invention, the preferred methods and materials are described.

As used herein, each of the following terms has the meaning associated with it in this section.

The articles "a" and "an" are used herein to refer to one or to more than one (i.e., to at least one) of the grammatical object of the article. By way of example, "an element" means one element or more than one element.

"About" as used herein when referring to a measurable value such as an amount, a temporal duration, and the like, is meant to encompass variations of ±20%, ±10%, ±5%, ±1%, and ±0.1% from the specified value, as such variations are appropriate.

The terms "gas cylinder," "gas cartridge," "gas tank," "gas container," and the like, are used interchangeably herein, and refer to any type of container or vessel suitable for holding a gas, preferably a pressurized gas.

Throughout this disclosure, various aspects of the invention can be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 2.7, 3, 4, 5, 5.3, 6 and any whole and partial increments therebetween. This applies regardless of the breadth of the range.

The present invention relates to gas cylinder safety interlock devices, systems, and methods, and also gas cylinders suitable for use with such interlock devices. The interlock device of the present invention includes a mechanism for preventing a gas cylinder from being detached or removed from a gas manifold or gas delivery device if the gas cylinder is not empty. The interlock device of the present invention is particularly useful in conjunction with therapeutic gas cylinders, because the interlock device can prevent undesired exposure to the therapeutic gas during application or exchanging/replacing of the cylinders. In addition, the interlock device of the present invention can prevent a person from disconnecting a pressurized cylinder from a gas delivery device, thereby preventing the cylinder from becoming a dangerous projectile.

In one embodiment, the safety interlock device of the present invention comprises one or more pins that are inserted into one or more grooves on a gas cylinder, and that remain inserted into the one or more grooves as long as the cylinder contains gas. Once the cylinder is emptied of gas, the pin disengages from the groove, allowing the gas cylinder to be disconnected and removed from the interlock device. Accordingly, the present invention also relates to a gas cylinder comprising at least one groove suitable for receiving the at least one pin of the cylinder interlock of the present invention. In one embodiment, the present invention relates to an adaptor comprising at least one groove that can be attached to a commercially-available gas cylinder, thus allowing the gas cylinder to be used with the gas cylinder interlock of the present invention.

In one embodiment, the one or more pins of the interlock device remain engaged with one or more grooves on a gas container as long as there is gas remaining in the gas container. In various embodiments, the interlock device includes a mechanism for determining whether gas remains in the gas container. In one embodiment, the mechanism is a pressure transducer or gas sensor. In another embodiment, the mechanism is at least one channel that is in communication with the gas-containing compartment of the gas container when the gas container is connected to the interlock device. In such an embodiment, gas from the gas container pressurizes the at least one channel, which in turn pushes the one or more locking pins into place in the one or more grooves on the cylinder. Accordingly, in such an embodiment, the one or more locking pins remain locked in place as long as there is sufficient pressure in the gas container to pressurize the at least one channel.

The gas cylinder interlock device of the present invention can be used with any type of device that requires the use of a gas cylinder. For example, the interlock device can be used with gas manifolds, dosing systems for therapeutic gases, or any other type of gas delivery or administration device. However, use of the interlock device of the present invention is not limited to any specific use described herein, and the interlock device can be used with any device that has a connection or port for receiving a gas cartridge or cylinder.

Further, the interlock device of the present invention can be used with any type of container suited for holding pressurized gases, such as, but not limited to: a gas cylinder, gas tank, or gas mini-cartridge. In a preferred embodiment, the interlock device of the present invention can be used with any type of gas container that is readily portable. In such an embodiment, the interlock device is particularly useful for preventing a relatively small gas container from being detached or disengaged from a gas administration device when gas still remains in the container.

Referring now to FIG. 1, one embodiment of a gas cylinder interlock device 110 of the present invention is shown, in which interlock 110 is disengaged from a gas cylinder 30. Interlock 110 includes a housing 120 and a nozzle 122 which can be connected to a conduit leading to a device utilizing the gas. The interior of interlock 110 includes a recessed port 124 for receiving gas cylinder 30. Interlock 110 has at least one pin 114 that is capable of projecting into recessed port 124 to form a lock when interlock 110 is attached to gas cylinder 30. A spring 117 surrounds each pin 114 to force pins 114 away from port 124 when a gas cylinder is not attached to interlock 110. Interlock 110 also includes a needle 112 for piercing a septum or seal on gas cylinder 30, thereby allowing gas to flow from gas cylinder 30 through nozzle 122. Gas cylinder 30 of the present invention includes a neck 33 with at least one groove 34 sized to receive the at least one pin 114 of interlock 110. In one embodiment, gas cylinder 30 can also include a threaded portion 32 on neck 33 for attaching cylinder 30 to interlock 110 by screwing cylinder 30 into port 124 on interlock 110, which can have a threaded portion complementary to threaded portion 32 on cylinder 30. In such an embodiment, the act of screwing cylinder 30 into interlock 110 can cause needle 112 to pierce a septum or seal on gas cylinder 30, thereby allowing gas to flow from cylinder 30.

Figure 2:
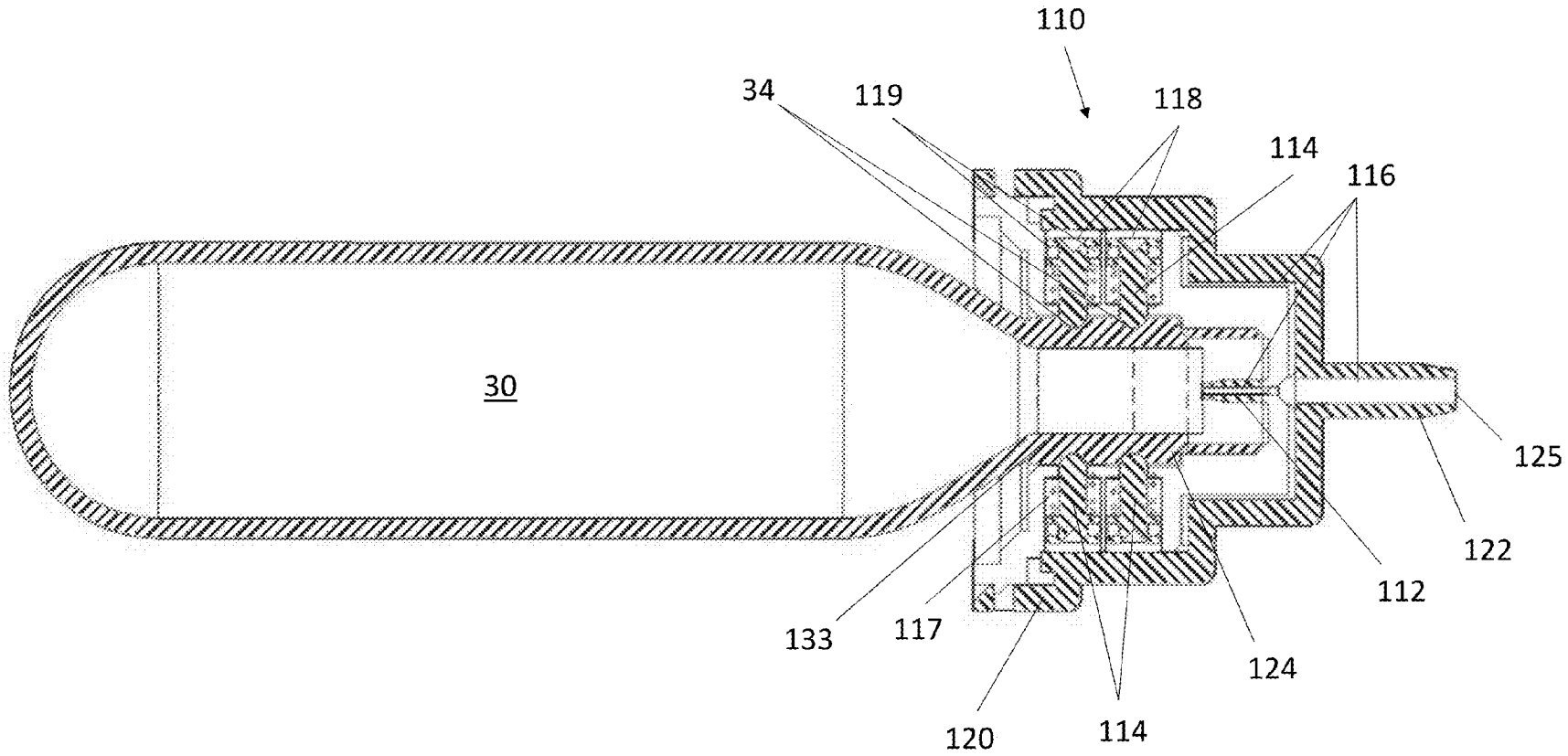
FIG. 2 is a schematic diagram of an exemplary embodiment of a gas cylinder interlock device of the present invention, connected to a gas cylinder with the pin mechanism engaged.

Referring now to FIG. 2, gas cylinder 30 is shown connected to interlock 110. Neck 33 of gas cylinder 30 is shown inserted into port 124 of interlock 110. Needle 112 of interlock 110 is connected to gas cylinder 30 such that the internal gas-holding space of gas cylinder 30 is in communication with a channel 116 in needle 112. Channel 116 in housing 120 of interlock 110 is also in communication with a gas outlet 125 in nozzle 122, such that gas in cylinder 30 can exit cylinder 30, travel through channel 116, through gas outlet 125, and into any device or tubing connected to nozzle 122. Further, channel 116 branches and is in communication with the back surface 118 of pins 114. Accordingly, as shown in FIG. 2, pins 114 are engaged with grooves 34 of cylinder 30 when gas from gas cylinder 30 pressurizes channel 116, thereby pushing on back surface 118 of pins 114 in order to force the tip of pins 114 into grooves 34. Thus, pins 114 form a locking mechanism in conjunction with grooves 34 to prevent cylinder 30 from being detached or disengaged from interlock 110 whenever there is sufficient pressure in gas cylinder 30 to push pins 114 into grooves 34, i.e., whenever there is sufficient pressure to overcome the force provided by springs 117. In one embodiment, such a pressure is any pressure greater than atmospheric pressure that overcomes the force provided by spring 117. Each pin 114 can include a seal 119 that prevents gas from leaking from channel 116 past pin 114 and into port 124.

Figure 3:
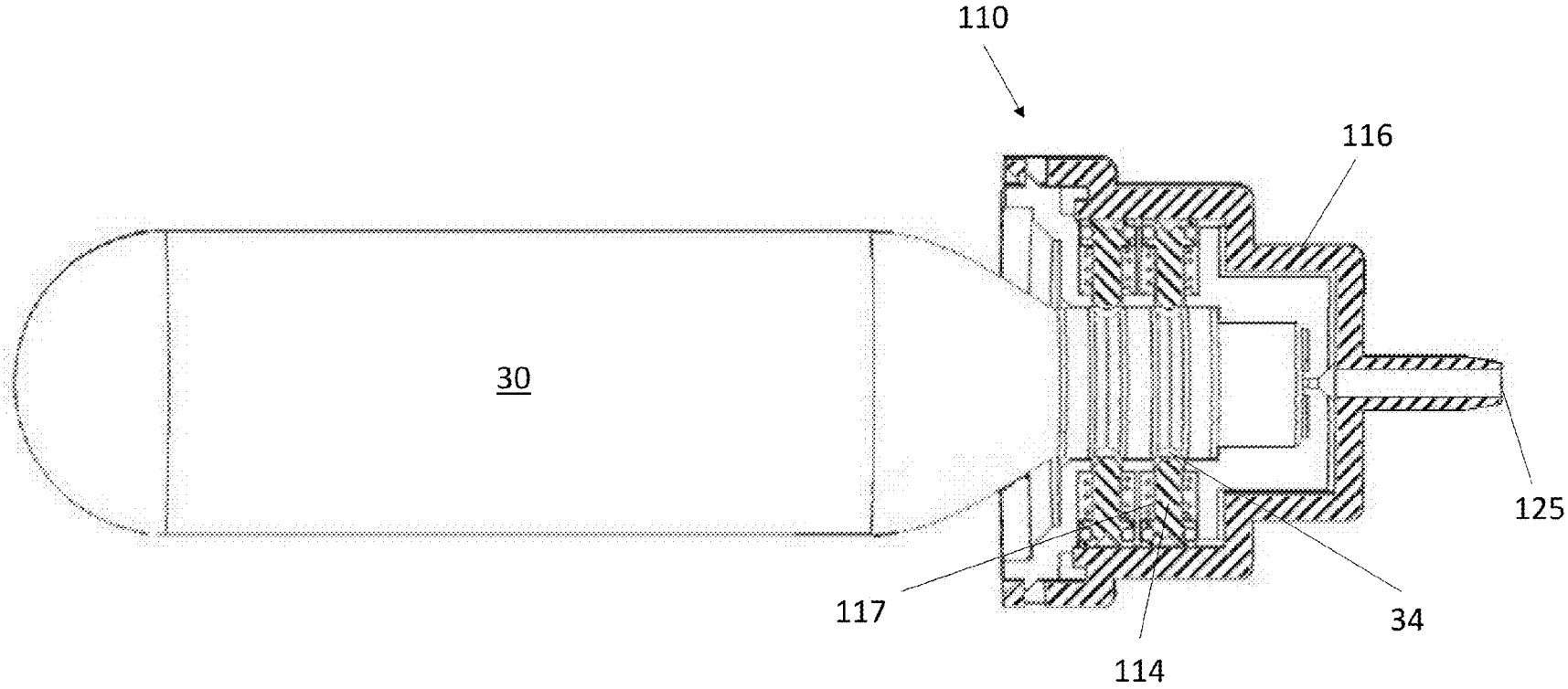
FIG. 3 is a schematic diagram of an exemplary embodiment of a gas cylinder interlock device of the present invention, connected to a gas cylinder with the pin mechanism disengaged.

Referring now to FIG. 3, when the gas in gas cylinder 30 is fully drained, i.e. cylinder 30 is empty or substantially empty, the pressure in channel 116 will reduce to about zero, thereby causing springs 117 to force pins 114 to disengage from grooves 34. Gas cylinder 30 can then be removed from interlock 110. Accordingly, interlock 110 of the present invention can prevent a user from unscrewing or otherwise removing cylinder 30 from interlock 110 prior to cylinder 30 being emptied of any gas or pressure.

Figure 4:
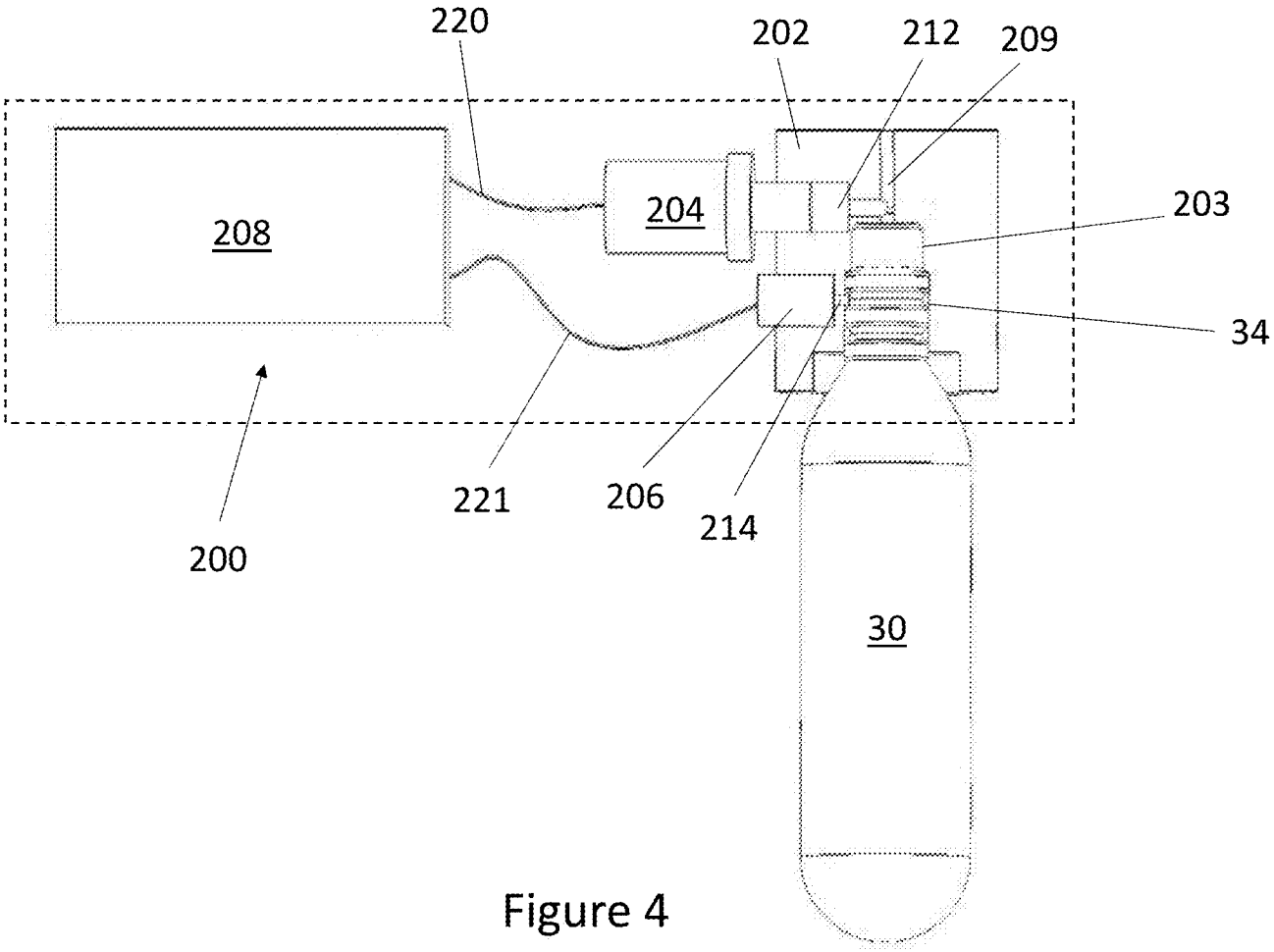
FIG. 4 is a schematic diagram of another exemplary embodiment of a gas cylinder interlock device of the present invention, attached to a gas cylinder with the pin mechanism engaged.

Referring now to FIG. 4, another embodiment of the gas cylinder interlock of the present invention is shown. Interlock 200 includes a housing 202 with a port 203 for receiving a gas cylinder 30. Interlock 200 includes a pressure transducer 204, a solenoid 206, and controller 208. When gas cylinder 30 is connected to interlock 200 via port 203, the internal gas-holding compartment of cylinder 30 is in communication with a channel 212 via the needle (not shown). Gas can flow out of cylinder 30 through and/or around the needle, into channel 212, and out of housing 202 via gas outlet 209. The locking mechanism of interlock 200 occurs as follows. Pressure transducer 204 is used to detect the presence of gas in channel 212. A signal is sent from pressure transducer 204 to controller 208 via a wire 220 indicating whether or not gas is detected in channel 212. If gas is detected, controller 208 sends a signal via a wire 221 to a solenoid 206, thereby causing solenoid 206 to apply force to the back surface of pin 214 to engage pin 214 into groove 34 of cylinder 30. Accordingly, whenever gas is detected by transducer 204, cylinder 30 will be locked into housing 202 of interlock 200. When cylinder 30 no longer contains gas, and transducer 204 does not detect gas in channel 212, controller 208 can send a signal to solenoid 206 to disengage pin 214 from groove 34, thereby allowing cylinder 30 to be removed from housing 202. In one embodiment, interlock 200 can operate via wireless communication, thus eliminating the need for wires 220 and 221.

In various embodiments, controller 208 of the interlock of the present invention can be any type of controller, as would be understood by a person skilled in the art. For example, the controller of the present invention can be an electromechanical device or a microprocessor. In various embodiments, solenoid 206 of the interlock of the present invention can be any type of mechanical, electromechanical, hydraulic, or pneumatic device or switch that can be used to force the one or more pins of the interlock into the one or more grooves of the cylinder, based on a signal from the controller.

In various embodiments, transducer 204 can comprise any type of device or sensor suitable for detecting the presence of a gas in channel 212, or in cylinder 30. In a preferred embodiment, transducer 204 senses the pressure within channel 212 and sends a signal to controller 208 indicating said pressure. When the pressure falls below a predetermined set point, controller 208 can send a signal to solenoid 206 to cause solenoid 206 to disengage the one or more pins of the interlock from the one or more grooves on the cylinder, thereby allowing cylinder 30 to be detached from the interlock. In one embodiment, the predetermined set point is zero bar gauge (barg), such that any pressure greater than atmospheric pressure will cause the controller to keep the pin mechanism engaged with the one or more grooves on the cylinder. In another embodiment, transducer 204 is a gas sensor or detector that determines if a gas is present in channel 212 based on a characteristic other than, or in addition to, pressure. For example, transducer 204 can comprise a gas or chemical sensor which detects the presence and/or concentration of a gas through electrical conductivity, or some other property known to be useful for determining the presence of a gas, as would be understood by a person skilled in the art.

In one embodiment, transducer 204 of the present invention can comprise more than one sensor. For example, in one embodiment, the transducer can comprise a pressure sensor and at least one gas or chemical sensor. In such an embodiment, the pin of the interlock of the present invention can be designed to stay locked in place until more than one predetermined set point is reached, i.e., both a pressure set point and at least one gas concentration set point. Therefore, even if the pressure drops below the pressure set point, the gas cylinder can remain securely locked in place if a very low, but still potentially harmful concentration of a gas is still present in channel 212 and/or gas cylinder 30. In yet another embodiment, transducer and/or controller can be used to determine the pressure or the presence of a gas in cylinder 30 instead of, or in addition to, channel 212. In such an embodiment, a gas cylinder may include a gauge or internal sensor that can be connected to the transducer and/or controller of the present invention. The interlock device of the present invention may also comprise a power source for providing power to the controller, solenoid, transducer, and/or any sensors included in the interlock. In one embodiment, if the power source stops providing power to the controller, the interlock device of the present invention can enter a failsafe mode wherein the pin mechanism left engaged until power is restored.

In one embodiment, the interlock of the present invention comprises at least one pin, i.e., a locking pin or pin mechanism, which is used to prevent a gas cylinder from being disconnected from a gas delivery device while there is still gas remaining in the gas cylinder. In various embodiments, the interlock device can comprise 1, 2, 3, 4, 5, 6, or more pins. In one embodiment, the pin can be substantially cylindrical in shape, i.e., the pin is rod-like. In another embodiment, the pin can be substantially conical in shape. In yet another embodiment, the pin can be in the shape of a collar, i.e., a half-circle. In one embodiment, the pin of the interlock device of the present invention comprises a tip that is suitably sized and shaped to be inserted into a groove on the outer surface of a gas cylinder. In such an embodiment, the tip of said pin, in conjunction with a groove on the outer surface of a gas cylinder, provides the locking mechanism of the present invention. However, the shape of the pin is not limited to any specific shape or size described herein, and the pin can be any shape that is suitable for engaging with a groove on a gas cylinder as would be understood by a person skilled in the art. In various embodiments, the pin of the interlock of the present invention has sufficient structural integrity to lock a pressurized gas cylinder securely in place without risk of the pin being bent or otherwise compromised.

In one embodiment, the present invention further relates to a gas cylinder with one or more grooves suitable for receiving a pin of the present invention. In such an embodiment, the grooves of the gas cylinder can be located anywhere on the outer surface of the gas cylinder. In another embodiment, the present invention relates to an adaptor comprising grooves suitable for receiving a pin of the present invention, wherein the adaptor can be securely attached to a gas cylinder. In such an embodiment, the adaptor can be attached to any type of commercially-available gas cylinder so that the gas cylinder can be used with the interlock device of the present invention. Such an adaptor can be suitable for placing around the neck of a gas cylinder or gas cartridge, or to any other part of a gas container that enables secure attachment. In various embodiments, the groove of the gas cylinder of the present invention is a recess on the outside of the gas cylinder that can be any shape or size suitable for receiving the pin of the interlock of the present invention. As would be understood by a person skilled in the art, the one or more grooves of the gas cylinder of the present invention are sized and shaped to retain the pin of the present invention, thereby preventing a gas cylinder from being detached from the interlock device, or repositioned within the interlock device. In a preferred embodiment, the groove is patterned around the entire circumference of a gas cylinder. In another embodiment, the groove is patterned on only a portion of a gas cylinder, i.e., less than the entire circumference of the cylinder. In one embodiment, the groove can be a hole or recess that substantially matches the cross-sectional shape and size of the pin.

As described herein, the interlock of the present invention can be used with any device that provides a connection for a gas cylinder. In one embodiment, the interlock of the present invention can further comprise any type of nozzle or fitting suitable for connecting the gas outlet of the interlock of the present invention to a gas manifold or other device that can be used to administer and/or consume gas from a gas cylinder. In one embodiment, the interlock device of the present invention comprises a valve. In such an embodiment, the valve is preferably connected to the nozzle or gas outlet of the interlock device. In one embodiment, the one or more sensors of the present invention can be integrated with the valve and/or the controller of the present invention, so that the valve can be automatically opened or closed based on data collected from the one or more sensors. In one embodiment, the housing of the interlock device of the present invention is connected to, or incorporated into, the housing of another device, for example a handheld gas delivery device.

The present invention also relates to a method for preventing a gas cylinder from being disconnected from a gas delivery device. In one embodiment, the method comprises the steps of: 1) connecting a gas cylinder to a gas delivery device, wherein the outer surface of the gas cylinder comprises at least one groove, the gas delivery device comprises an interlock, and wherein the interlock comprises at least one pin; and 2) inserting the at least one pin into the at least one groove. In one embodiment, once the at least one pin is inserted into the at least one groove, the at least one pin will remain inserted into the at least one groove for as long as the gas cylinder contains gas, i.e., until the gas cylinder is empty. In one embodiment, the pin is engaged with said groove via a controller and solenoid, as described herein. In such an embodiment, the engagement of the pin with the groove can be based on data gathered by a sensor, for example by sensing the pressure or the concentration of one or more gases within the gas cylinder, the interlock device, and/or the gas delivery device. In one embodiment, the pin remains engaged with the groove on the cylinder when the pressure of gas sensed is greater than atmospheric pressure, i.e., zero gauge pressure. In such an embodiment, the pin can remain engaged with the groove on the cylinder when the pressure of gas sensed is greater than a set point, for example, but not limited to 0.1 psi gauge (psig), 0.5 psig, 1 psig, 2 psig or any other value for pressure as would be understood by a person skilled in the art. In another embodiment, the pin remains engaged with the groove on the cylinder when the sensed concentration of a specific gas, for example nitric oxide, is greater than zero. In yet another embodiment, the pin remains engaged with the groove on the cylinder when the sensed concentration of a specific gas is greater than a set point, for example, but not limited to 1 part per million (ppm), 2 ppm, 5 ppm, 10 ppm, or any other value for concentration as would be understood by a person skilled in the art.

The disclosures of each and every patent, patent application, and publication cited herein are hereby incorporated herein by reference in their entirety.

While this invention has been disclosed with reference to specific embodiments, it is apparent that other embodiments and variations of this invention may be devised by others skilled in the art without departing from the true spirit and scope of the invention. The appended claims are intended to be construed to include all such embodiments and equivalent variations.

The invention claimed is:

1. An interlock device for a gas cylinder having at least one groove adjacent to a gas outlet, the interlock device comprising:

a housing having a port for receiving a gas outlet of a gas cylinder;

a needle for connecting said gas outlet to said housing port, said needle having a lumen;

at least one channel in said housing, wherein said at least one channel is in communication with said needle lumen;

a transducer, wherein said transducer is in communication with said at least one channel;

a nozzle having a lumen, wherein said nozzle lumen is in communication with said at least one channel;

at least one pin connected to said housing, said pin having a back surface and a tip;

a solenoid connected to said back surface of said at least one pin; and a controller, wherein said controller receives signals from said transducer and can send signals to said solenoid;

wherein when said gas outlet of a gas cylinder containing gas is connected to said housing port, said gas flows through said gas outlet, through said needle lumen, into said at least one channel, and through said nozzle lumen;

and wherein said gas cylinder outlet is locked within said housing port when said solenoid forces said at least one pin tip to engage with the at least one groove of said gas cylinder.

2. The device of claim 1, wherein said solenoid forces said at least one pin tip to engage with said gas cylinder outlet when said transducer senses a pressure in said at least one channel.

3. The device of claim 2, wherein said pressure is a pressure greater than atmospheric pressure.

4. The device of claim 1, wherein said solenoid forces said at least one pin tip to engage with said gas cylinder outlet when said transducer senses a concentration of a gas in said at least one channel.

5. The device of claim 1, wherein said controller sends and/or receives signals wirelessly.

6. The device of claim 1, wherein said controller sends and/or receives signals via wires.

7. The device of claim 1, further comprising a valve connected to said nozzle.

* * * * *